United States Patent [19]

Hayashi

[11] Patent Number: 4,625,873

[45] Date of Patent: Dec. 2, 1986

[54] GARMENT RACK

[76] Inventor: Keiichiro Hayashi, 31 Carol Rd., Westfield, N.J. 07090

[21] Appl. No.: 605,193

[22] Filed: Apr. 30, 1984

[51] Int. Cl.[4] ..... A47F 5/08

[52] U.S. Cl. ..... 211/119; 211/124; 211/150

[58] Field of Search ..... 211/119, 116, 150, 105.1, 211/123, 124, 16

[56] References Cited

U.S. PATENT DOCUMENTS

| | | | |
|---|---|---|---|
| 205,106 | 6/1878 | Largent | 211/124 X |
| 426,697 | 4/1890 | Webb | 211/150 |
| 500,879 | 7/1893 | Frankel | 211/119 |
| 622,742 | 12/1902 | Oldham | 211/124 X |
| 946,337 | 1/1910 | Clear | 211/150 X |
| 1,039,694 | 10/1912 | Burton | 211/150 X |
| 1,618,157 | 2/1927 | Harmon | 211/119 X |
| 1,619,434 | 3/1927 | Reese | 211/119 X |
| 2,271,941 | 2/1942 | Kemmitt | 211/119 X |
| 2,577,397 | 12/1951 | Bailey | 211/119 X |
| 2,675,130 | 4/1954 | Dore | 211/119 X |
| 2,735,737 | 2/1956 | Hancock | 211/150 X |
| 2,908,397 | 10/1959 | Patterson | 211/150 X |
| 3,352,430 | 11/1967 | McAtee | 211/123 X |
| 4,448,380 | 5/1984 | Huber-Krattiger | 211/150 X |

*Primary Examiner*—J. Franklin Foss
*Assistant Examiner*—Sarah A. Lechok Eley
*Attorney, Agent, or Firm*—Robert S. Salzman

[57] ABSTRACT

A compact garment rack features a master frame that attaches to a pole or wall fixture in a closet. The master frame has a series of tiered sub-frame sections that are articulated with respect to the master frame. Each sub-frame section has a respective hanger rod member that carries an item of apparel. The sub-frame sections are movable from a generally fold-down position to an open access position. When a sub-frame section is in the open access position, its corresponding hanger rod member is slidably disengageable from the sub-frame section, whereby the apparel item can be easily inserted or removed from the rack.

12 Claims, 4 Drawing Figures

FIG. 1
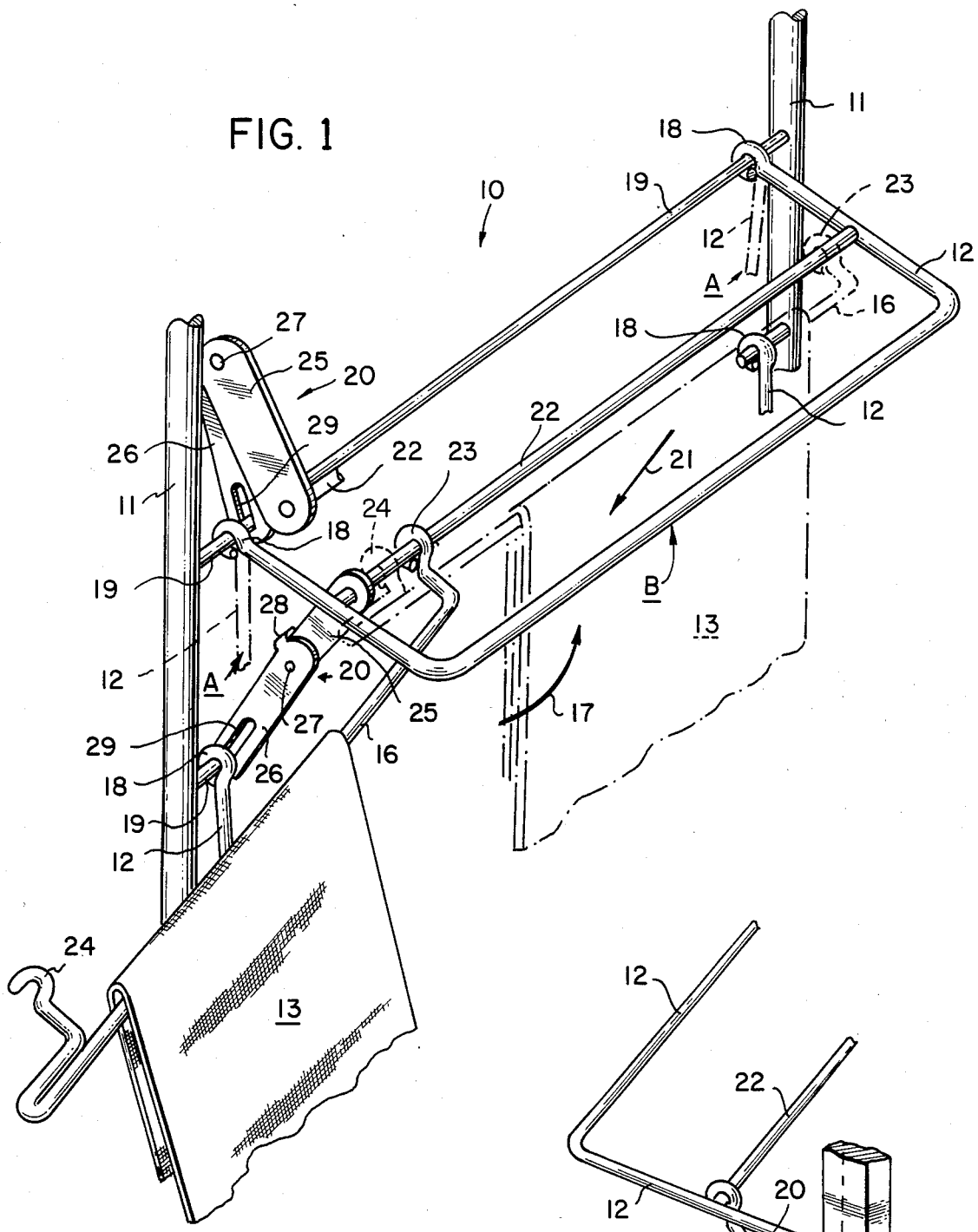
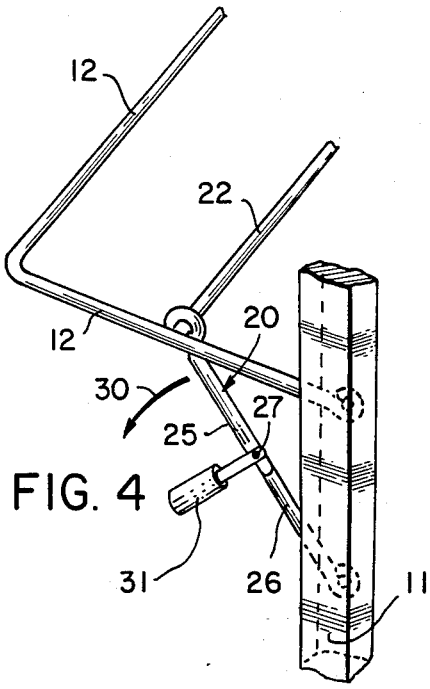
FIG. 4

GARMENT RACK

FIELD OF THE INVENTION

This invention relates to garment and apparel storage devices, and more particularly to a multiple tiered garment rack for storing and accessing a number of garments in a convenient and facile manner.

BACKGROUND OF THE INVENTION

In a personal closet there is very often not enough space to hang a large number of slacks or dresses. Even where there is ample closet area, slacks and other garments tend to become tightly interleaved. This tightly interleaved condition presents many disadvantages, e.g. the clothes are many times so tightly packed together that their removal is difficult. When such a difficulty arises, replacing these garments becomes as great a chore as was their removal. The clothes also tend to become creased and wrinkled from severely dense packing. Even the ordinary hangers present problems, to wit, (1) they do not always pack well, (2) are of different shapes and sizes, and (3) are themselves often heavy and bulky.

The present invention seeks to provide a garment rack for general usage in a personal closet. The invention allows for dense packing of the garments in a neat and orderly fashion with the opportunity for easily and efficaciously removing and inserting the garments upon the rack.

The invention also features a garment rack that has a minimum of manufactured and movable parts.

Another advantage of the inventive garment rack is its uncomplicated construction and usage.

SUMMARY OF THE INVENTION

The invention pertains to a garment rack for the mounting and removal of apparel therefrom in a facile manner. The rack comprises a master frame generally made of tubular metal, such as aluminum or steel. The master frame has a plurality of tiered sub-frame sections that each support an individual apparel item. Each sub-frame section is movable from a generally flat, fold-down position to an open access position wherein the apparel item can be easily accessed and separated from the sub-frame section.

Each of the sub-frame sections has a respective hanger rod member for supporting the apparel item. The hanger rod members are each movable upon their corresponding sub-frame section, from a generally secured apparel position to an openly removable apparel position wherein the apparel item can be easily removed or inserted upon the rack.

The master frame is substantially rectangular with a hook disposed on an upper portion thereof for attachment to a closet pole or fixture.

The sub-frame sections each generally comprise a U-shaped frame member whose ends are articulated with respect to the master frame and which is partially rotatable thereabout.

The hanger rod members include a holding bracket for operationally securing each corresponding sub-frame section in its openly accessible position.

The hanger rod members have a hook on one end to disengage it from the sub-frame section. The hanger rod members are each slidable upon their corresponding sub-frame sections about their distal end.

The holding brackets comprise in one embodiment a friction hinge for maintaining the brackets in an open position. A biased detent may also be used for this purpose. The holding brackets include a two-piece member that is articulated about its mid-portion, and connected between the master frame and a respective hanger rod member.

The garment rack frame and most of its elements are of tubular construction.

In one embodiment, the holding brackets each have a handle disposed about a sub-portion thereof, for rotating said corresponding sub-frame sections.

It is an object of this invention to provide an improved garment rack.

It is another object of the invention to provide for a garment rack wherein all the apparel items fold flat in a storage mode, but are easily accessible at the time of removal or insertion into the rack.

These and other objects of this invention will be better understood and will become more apparent with reference to the subsequent detailed description considered in conjunction with the accompanying drawings.

BRIEF DESCRIPTION OF THE DRAWINGS

FIG. 1 is a partial perspective view of the garment rack of this invention, illustrating the hanger rod member in a disengaged position in solid line, and a engaged position in phantom, upon an extended sub-frame section;

FIG. 4 is a partial perspective view of an alternate embodiment of the holding bracket of the garment rack depicted in FIG. 1.

DETAILED DESCRIPTION OF THE INVENTION

Generally speaking, the subject invention features a garment rack comprised of a main or master frame having a series of tiered sub-frame members. Each sub-frame member supports an article of apparel in either a flat, fold-down, storage position or an openly accessible position wherein the apparel can be easily removed or inserted into the rack.

Figure 2:
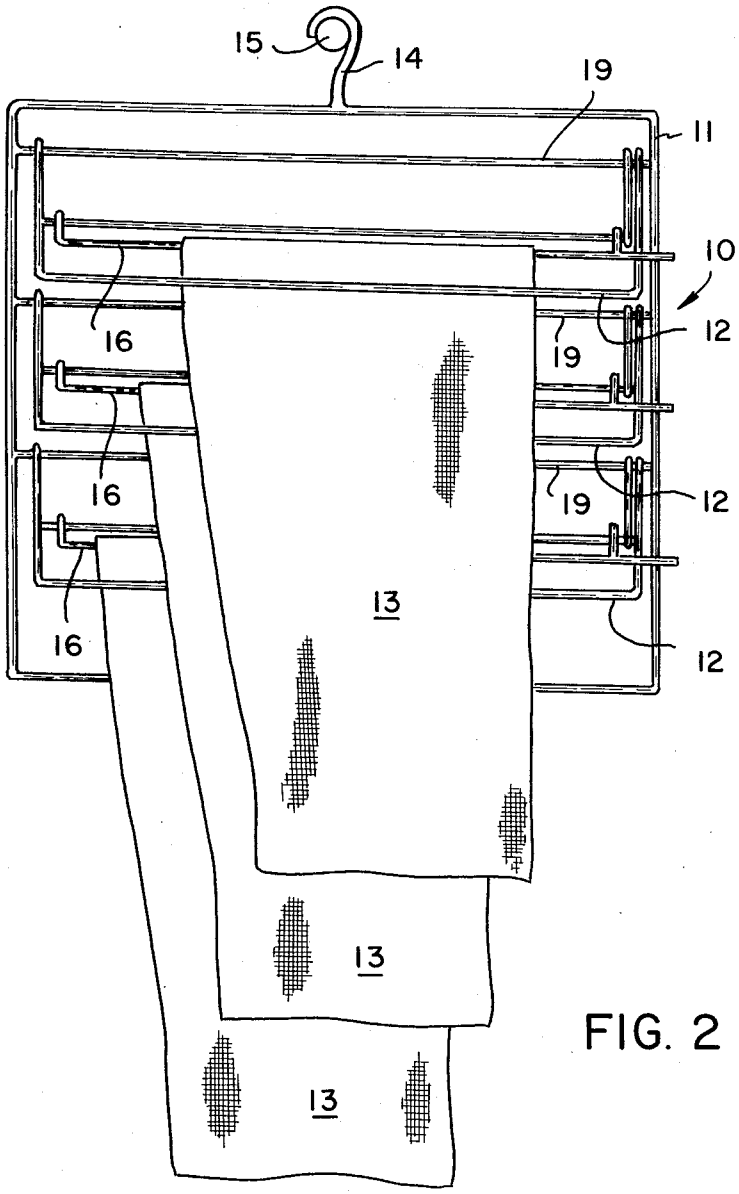
FIG. 2 is a front view of the garment rack shown in FIG. 1, with all the sub-frame sections in a flat, fold-down position.

Now referring to FIG. 2, the garment rack 10 of this invention is illustrated in a front view. The garment rack 10 is comprised of a tubular master frame 11 having a plurality of tiered or vertically spaced-apart sub-frame sections 12. In the storage mode of operation, the garment rack 10 features all of the apparel items, such as slacks 13, in a flat-fold-down position, as seen in FIG. 2. In the storage mode, the slacks 13 are neatly, and compactly hung upon rack 10, which is itself conveniently hung within a closet by means of hook 14 that hooks about a pole 15 or upon a wall fixture (not shown).

Each sub-frame section 12 has a hanger rod member 16 upon which the slacks 13 is hung. Each hanger rod member 16 is slidably detachable (arrow 21) from its sub-frame section 12, when its sub-frame section is in an open accessible position, as is illustrated in FIG. 1, and which will be explained in more detail hereinafter. In this position, the garment rack is in an operational mode wherein a pair of slacks 13 can be easily removed or inserted upon the extended hanger rod member 16.

For the purpose of clarity, all like elements will have the same designations in each figure of the drawings.

In the aforementioned fold-down position, designated position "A" in FIG. 1, the sub-frame section 12 is shown partially in phantom. In the open accessible or extended position, designated position "B", shown in solid lines, a sub-frame section 12 is rotated upwardly as illustrated by arrow 17. Only one sub-frame section 12 is in the open accessible position "B" at any one time.

The sub-frame section 12 has a generally U-shaped appearance, and is articulated about the master frame 11. This is accomplished by means of eye-bolts 18 at the distal ends of the sub-frame section 12. These eye-bolts 18 rotatively mount to the cross-beam 19 affixed across the master frame 11, which adds structural support to the master frame 11 as a stiffening strut. The sub-frame section 12 likewise has a stiffening rod 22 upon which the hanger rod member 16 is mounted in an articulated fashion by closed eye-bolt 23 and an open eye bolt 24, respectively.

A holding bracket 20 limits the travel in the upward direction (arrow 17) of each sub-frame section 12. The holding bracket 20 is comprised of two arms 25 and 26, respectively, that are frictionally hinged about pin 27, so that they maintain their position. The fully open bracket position illustrated for the open subframe position "B", shows arms 25 and 26 extended in a straight line. A limiting stop 28 prevents the arm 25 from extending past arm 26 more than top dead center. A slot 29 allows for the extended movement of arm 26. The upper bracket 20 for the next tiered subframe section is also shown in the folded down position, i.e. arms 25 and 26 are at an acute angle with respect to each other. This position corresponds to the folded down position "A" of the next tiered subframe section 12.

Figure 3:
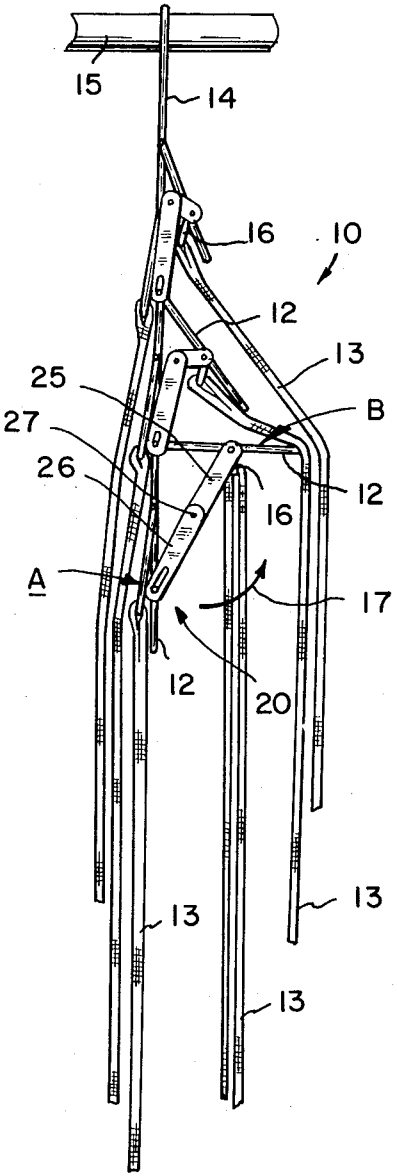
FIG. 3 is a side sectional view of FIG. 2, with one of the sub-frame sections in an open accessible position.

Also see FIG. 3 for a better understanding of how one subframe section 12 is extended to position "B" within the garment rack 10.

OPERATION OF THE INVENTION

When an item of apparel, such as slacks 13, is to be inserted or removed from the garment rack 10, an empty subframe section 12 is pulled upwardly (arrow 17) about its outer U-shaped frame from the fold down position "A" to the open position "B". The hanger rod member 16 is then disengaged from the sub-frame section 12, by snapping the left side eye-bolt 24 from stiffening rod 22 connected across the sub-frame section. The hanger rod member 16 is then slidably moved in the direction of arrow 21, where a pair of slacks 13 is easily inserted over the hanger rod member 16, or removed therefrom.

Next, the hanger rod member 16 is slidably moved in an opposite direction to arrow 21, to place the hanger rod member 16 back upon the sub-frame section 12. The open eye-bolt 24 is engaged to rod 22 to lock the hanger rod member 16 to sub-frame section 12.

Then, the sub-frame section 12 is rotatively returned to fold-down position "A".

It will be seen from the various illustrations, that the slack 13 fits compactly within the other slacks 13 in position A, but is held away from the other slacks 13 in position B, and is not caused to interfere with any of the other slacks or parts of the garment rack 10. The garment rack is compact when all the slacks 13 are folded down, and expands to a very convenient and open position when one of the sub-frame sections is expanded to position B.

Thus, it is evident that the invention provides a garment rack having the many advantages previously attributed to it.

Referring to FIG. 4, an alternate embodiment is shown for the bracket 20 of FIGS. 1 and 3. In this embodiment, the bracket 20 is folded in a downward direction 30, wherein the arms 25 and 26 are disposed below rod 22 in the folded position (not shown). A handle 31 can be attached about the joint 27 to assist the movement of the bracket 20 and sub-frame 12. This bracket 20 does not require a slot 29.

The frame and sub-elements can be made of tubular plastic or aluminum for lightness.

Having thus described the invention, what is desired to be protected by Letters Patent is presented in the subsequent appended claims.

What is claimed is:

1. A garment rack for the mounting and removal of apparel therefrom in a facile manner, comprising: a master frame for supproting said apparel, said master frame having a plurality of tiered sub-frame sections each supporting an individual apparel item, each of said sub-frame sections being movable from a generally flat, fold-down position to an open, access position wherein said apparel item can be easily accessed and separated from said sub-frame section, each of said sub-frame sections having a respective hanger rod member each being slidably movable substantially laterally across a corresponding sub-frame section from a generally secured apparel position at one end of said sub-frame therefrom and the rack is of tubular construction.

2. The garment rack of claim 1, wherein said master frame is substantially rectangular.

3. The garment rack of claim 1, wherein said master frame has a hook disposed upon an upper portion thereof for attachement to a closet pole or fixture.

4. The garment rack of claim 1, wherein each sub-frame section generally comprises a U-shaped frame member whose ends are articulated with respect to said master frame, and further wherein each of said sub-frame sections is partially rotatable about said master frame.

5. The garment rack of claim 1, wherein each of said hanger rod members further includes a holding bracket for operationally securing each corresponding sub-frame section in said openly accessible position.

6. The garment rack of claim 1, wherein each of said hanger rod members includes a hook disposed on one end thereof, for disengaging each of said hanger rod members from said corresponding sub-frame section.

7. The garment rack of claim 5, wherein each of said holding brackets comprises a friction hinge for maintaining each of said brackets in an open position.

8. The garment rack of claim 5, wherein each of said holding brackets comprises a biased detent for maintaining each of said brackets in an open position.

9. The garment rack of claim 5, wherein each of said holding brackets includes a two-piece member that is articulated about a mid-portion thereof.

10. The garment rack of claim 5, wherein each holding bracket is connected between said master frame and a respective hanger rod member.

11. The garment rack of claim 5, wherein each holding bracket has a handle disposed about a mid-portion thereof, for rotating the corresponding sub-frame section.

12. The garment rack of claim 1, wherein said master frame and said sub-frame sections generally have a tubular construction.

* * * * *